United States Patent [19]

Fenne et al.

[11] 4,325,676

[45] Apr. 20, 1982

[54] LIQUID FUEL PUMPING APPARATUS

[75] Inventors: Ivor Fenne, Greenford; Richard J. Andrews, Guildford, both of England

[73] Assignee: Lucas Industries Limited, Birmingham, England

[21] Appl. No.: 98,043

[22] Filed: Nov. 28, 1979

[30] Foreign Application Priority Data

Jan. 16, 1979 [GB] United Kingdom ..... 01595/79

[51] Int. Cl.[3] ..... F04B 23/10; F04B 23/12

[52] U.S. Cl. ..... 417/206; 417/251; 417/462; 123/450

[58] Field of Search ..... 417/206, 251–253, 417/462; 123/450, 502

[56] References Cited

U.S. PATENT DOCUMENTS

| | | | |
|---|---|---|---|
| 2,641,238 | 9/1953 | Roosa | 417/252 |
| 2,989,003 | 6/1961 | Evans | 417/206 |
| 3,292,546 | 12/1966 | Evans | 417/206 |
| 3,363,568 | 1/1968 | Evans | 417/252 |
| 3,421,444 | 1/1969 | Hutcheon et al. | 123/495 |
| 3,427,979 | 2/1969 | Kemp | 417/206 |
| 3,439,624 | 4/1969 | Gliken et al. | 417/206 |
| 3,460,479 | 8/1969 | Kemp | 417/253 |

FOREIGN PATENT DOCUMENTS

| | | | |
|---|---|---|---|
| 1210234 | 10/1970 | United Kingdom | 417/462 |

*Primary Examiner*—William L. Freeh

[57] ABSTRACT

A fuel pumping apparatus includes an injection pump which is supplied with fuel through a passage from a feed pump. A throttle member having a groove is angularly adjustable to determine the rate of fuel flow. For this purpose the groove has variable communication with a port at the end of the passage. The throttle member has a further groove which when the throttle is closed to prevent fuel flow to the injection pump, places the port in communication with a further port connected to a low pressure. This allows fuel to be expelled from the injection pump so that delivery of small amounts of fuel to the engine does not occur when the throttle is closed.

6 Claims, 4 Drawing Figures

LIQUID FUEL PUMPING APPARATUS

This invention relates to fuel injection pumping apparatus for supplying fuel to an internal combustion engine and of the kind comprising a housing, a distributor member rotatable within the housing, an injection pump including a rotary part rotatable with the distributor member, a bore formed in said rotary part, a pumping plunger located in said bore, a cam ring located in the housing, said cam ring having spaced cam lobes which can impart inward movement to the plunger as the rotary part and distributor member rotate, a plurality of outlet ports formed in the housing and which in use, are connected to fuel injection nozzles respectively of an associated engine, a delivery passage in the distributor member, said delivery passage communicating with said bore and being positioned to register with the outlet ports in turn during successive periods of inward movement of the plunger, fuel supply means in the housing and distributor member through which fuel can flow to said bore at least during part of the time the delivery passage is out of register with an outlet port, said fuel supply means including a supply passage in the housing, a source of fuel under pressure for supplying fuel to said supply passage and throttle means for controlling the flow of fuel through said supply passage.

Apparatus of the kind specified is well known in the art. The throttle means in practice is associated with a governor responsive to the speed of the associated engine whereby as the engine speed attains its allowed maximum speed the flow of fuel is reduced to prevent overspeeding of the engine. The flow of fuel from the source should be cut off under conditions where the engine speed rises above the allowed maximum speed. Such overspeeding of the engine can occur for example when the vehicle driven by the engine, is descending a hill. Under such conditions it has been found that there is a tendency for very small quantities of fuel to be supplied to the injection nozzles and therefore to the engine. The small quantity of fuel does not burn correctly and as a result hydrocarbons are emitted from the engine exhaust. The small quantities of fuel which flow to the engine arise as a result of various factors for example leakage of fuel in the throttle.

The object of the present invention is to provide an apparatus of the kind specified in a form in which the flow of fuel to the engine in the aforesaid small quantities is obviated.

According to the invention in an apparatus of the kind specified means is provided which is operable in association with said throttle means, for allowing the bore to be vented to a low pressure when the throttle means is set to prevent fuel flow from said source to the bore.

One example of an apparatus in accordance with the invention will now be described with reference to the accompanying drawings in which.

Figure 1:
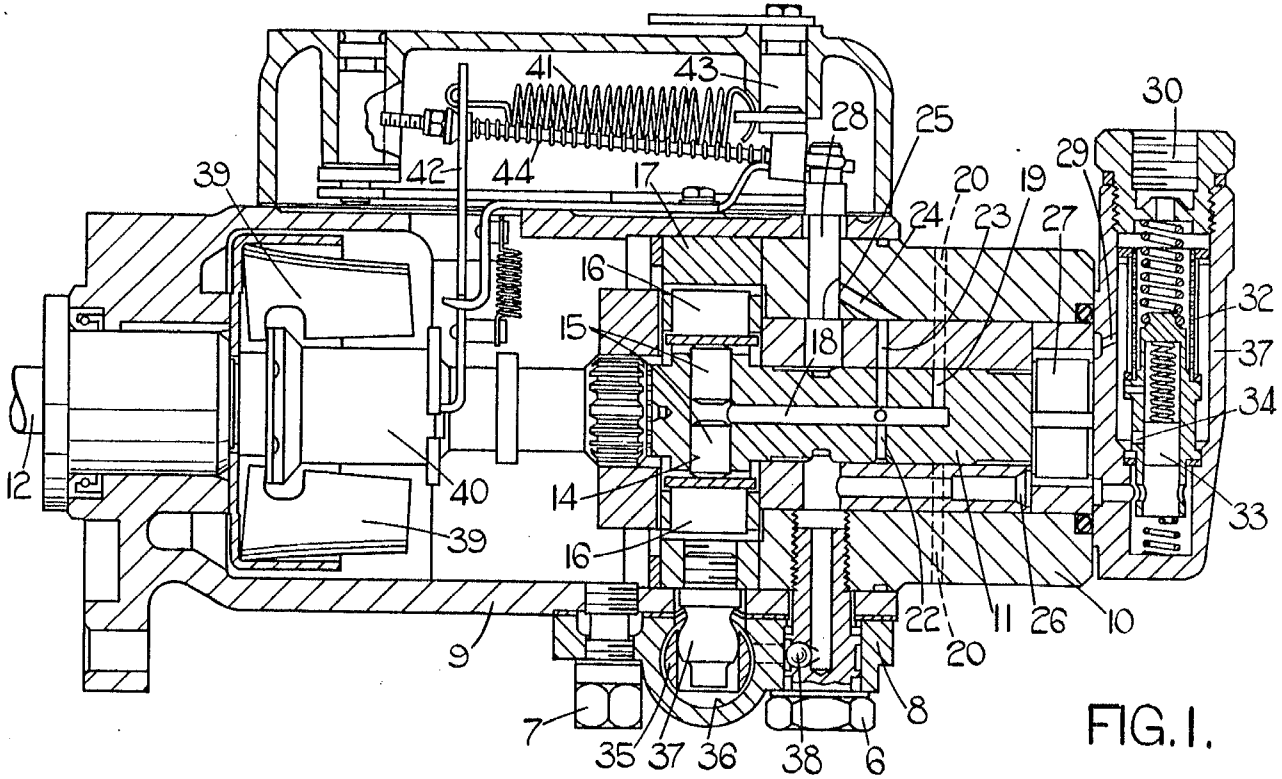
FIG. 1 is a sectional side elevation of the apparatus.

Referring to FIG. 1 of the drawings, the apparatus comprises a two part housing 9, 10, the housing part 9 being provided with an open end in which is located the housing part 10. The part 10 has a close fitting relationship with the wall of the bore defined in the part 9.

Formed within the part 10 of the housing is a bore in which is located a rotary cylindrical distributor member 11 and this is coupled to an input shaft 12 which is located in the part 9 of the housing. The shaft 12 is adapted to be driven in timed relationship with an engine with which the apparatus is associated. Formed in an enlarged portion of a distributor member is a bore 14 in which is mounted a pair of reciprocable plungers 15 which are arranged to be moved inwardly as the distributor member rotates, by cam lobes not shown, formed on the internal peripheral surface of an annular cam ring 17. Rollers 16 carried in suitable shoes, are interposed between the internal surface of the cam ring and the plungers 15 and the cam ring 17 is movable angularly within the housing for the purpose of adjusting the timing of delivery of fuel.

Also formed in the distributor member 11 is a longitudinally extending passage 12 which at one end is in communication with the transverse bore and at its other end in communication with a radially disposed delivery passage 19. This latter passage extends to the periphery of the distributor member and is positioned to register in turn and as the distributor member rotates, with a plurality of outlet ports 20, to which in use, are connected the fuel injection nozzles of the associated engine.

The registration of the delivery passage 19 with an outlet port takes place during the whole time the plungers 15 are capable of being moved inwardly by the cam lobes so that liquid fuel contained in the bore 14 will be displaced to a combustion space of the engine. Moreover, the fact that the annular cam ring is movable angularly must also be taken into account when determining the size of the delivery passage and the delivery ports.

At another point the longitudinal passage 18 is in communication with a plurality of equiangularly spaced and radially disposed inlet passages 22 which are arranged to register in turn with an inlet port 23 formed in the part 10 of the housing. The inlet port 23 communicates with a supply passage 24 in the housing and the port 23 and passages 22 form a fuel supply means. The passage 24 also forms part of this means and terminates in a port 25 which is formed in the wall of a bore which accommodates an angularly movable throttle member 28. The throttle member has a groove formed thereon which varies the effective size of the port 25 and thereby by varying the angular position of the throttle member 28, the amount of fuel which can flow through the supply passage when the inlet port 23 is in communication with an inlet passage 22, can be controlled. The registration of the inlet port with one of the inlet passages takes place only during the time when a delivery passage 19 is out of register with an outlet port 20. By adjusting the setting of the throttle member, the amount of fuel which can flow to the bore 14 can be varied and hence also the amount of fuel delivered to the engine.

A feed pump 27 is provided, the rotary part of which is secured to the end of the distributor member 11. The feed pump is of the vane type and it has an inlet 29 and an outlet 26. The outlet 26 communicates by way of the groove in the throttle member with the supply passage 24. The inlet of the feed pump is connected to a fuel inlet 30 which is formed in a part 37 secured to the housing portion 10. The part 37 incorporates a filter 32 and a relief valve which includes a spring loaded element 33 which depending upon the pressure applied to it from the outlet 26 of the feed pump uncovers to a greater or lesser extent a spill port 34 which communicates with the inlet 29 of the pump. The effect of the valve is to control the outlet pressure of the pump so that it varies in accordance with the speed at which the distributor member rotates and therefore the speed of the associated engine.

As previously mentioned the cam ring 17 is angularly adjustable and this adjustment is achieved by means of a spring loaded piston 35 which is located within a cylinder 36. The cam ring is connected to the piston by means of a peg 37 and fuel is supplied to one end of the cylinder from the outlet 26 of the feed pump by way of a passage which is conveniently formed in a retaining bolt 6 which is utilised to secure the housing parts 9 and 10 together and also a further part 8 which accommodates the cylinder 36. A further bolt 7 is also provided to retain the part 8 to the part 9 of the housing. Moreover, an anti-shock valve 38 is provided in the passage connecting the outlet 26 to the cylinder 36. The arrangement is such that the position of the cam ring varies in accordance with the output pressure of the feed pump. The valve 38 acts to prevent movement of the piston due to the reaction of the rollers with the cam lobes.

The angular setting of the throttle member 28 is controlled by a mechanical governor which includes weights 39 accommodated within a cage mounted on the shaft 12. Also mounted on the shaft 12 is an axially movable flanged collar 40 which engages one end of a pivotal lever 42. The sleeve is also engaged by portions of the weights and the other end of the lever 42 is connected to a governor spring 41. As the weights move outwardly with increasing speed, the lever 42 is moved in a direction to stretch the spring 41. The other end of the spring 41 is connected to a manually operable lever whereby the force exerted by the spring can be varied. In addition the aforesaid end of the lever 42 is connected by means of a link 44 to an arm carried by the throttle member 28. The arrangement is such that for a given setting of the manually operable member, as the speed of the associated engine increases, the throttle member will move to reduce the amount of fuel flowing to the bore 14 and hence to the associated engine. A governing action is therefore obtained. At a predetermined maximum speed the throttle member will move to the closed position and no more fuel will be supplied from the feed pump to the bore 14.

It is usual with such forms of apparatus to include so called unloading delivery valves in the outlets 20 or to provide a single such delivery valve in the delivery passage 19. The purpose of such a valve is to allow a predetermined volume of fuel to flow back towards the bore 14 from the pipe lines connecting the outlets with the injection nozzles. The return flow of fuel takes place whilst the plungers can move outwardly, in other words after the rollers have passed over the crests of the cam lobes and whilst the delivery passage 19 is still in register with the outlet. In this manner the pressure in the pipe line is reduced by a predetermined amount and the reduction of pressure does assist the closing of the valves in the injection nozzles. Even if no delivery valve is employed there will be a return flow of fuel from the pipe line to the bore 14. Even with the throttle member in the cut off position there will therefore still be fuel in the bore 14 and whilst the volume of fuel should in theory be all that is required to pressurise the pipe line and not cause injection when the plungers are next moved inwardly, it is found that small volumes of fuel continue to be discharged through the injection nozzles. This is thought to be due to, amongst other things, leakage of fuel past the throttle member and by pressure waves generated by the inward movements of the plungers.

The small quantities of fuel which flow to the engine in this condition are not properly atomised and therefore there is a tendency for hydrocarbon emission from the engine exhaust.

Figure 2:
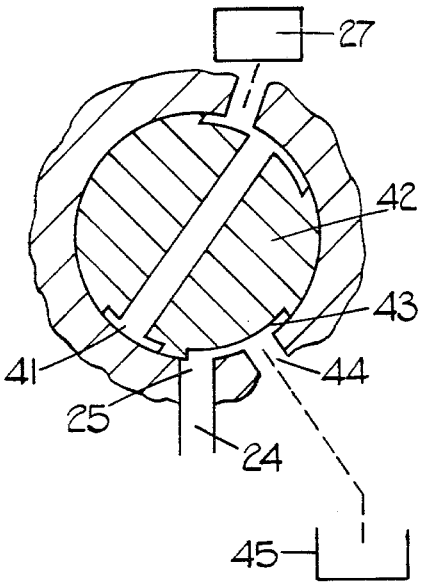
FIGS. 2 and 3 are schematic diagrams of a part of the apparatus shown in FIG. 1.
Figure 3:
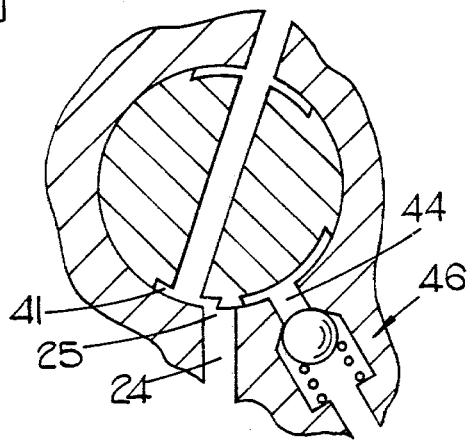

Turning now to FIG. 2 of the drawings, a diagrammatic representation of the throttle member 28 is shown at 42 and it has on its periphery, a groove 41 which through a passage extending through the throttle member, is in communication with a further groove which is in constant communication whatever the position of the throttle member, with the outlet of the feed pump 27. The port 25 is shown together with the connecting passage 24. In the position shown in FIG. 2 the groove 41 is out of communication with the port 25 and this therefore represents the cut-off position of the throttle member such as occurs when the engine has exceeded its maximum governed speed. In FIG. 3, the throttle member is moved angularly to a position in which the groove 41 is in partial register with the port 25 and hence fuel can be supplied to the bore 14 when the registration of an inlet passage 22 with the inlet port 23 takes place. The metering valve 42 is provided with an additional groove 43 which can communicate and does communicate with the port 25 when as shown in FIG. 2, the throttle member is moved to the cut off position. The groove 43 communicates with a port 44 and this port communicates with a drain conveniently indicated as a fuel tank 45. As shown in FIG. 3, when the metering valve is set so that fuel is supplied to the bore 14, the groove 43 is out of register with the port 25.

The various cavities within the housing contain fuel under pressure, this fuel being fuel which has leaked from the various components of the apparatus. For example fuel leaks past the plungers 15 and the piston 35 is constructed so that there is a leak from the end of the cylinder 36 to which fuel is supplied under pressure. A pressurising valve not shown, is provided to ensure that the pressure within the cavity is higher than atmospheric pressure but less than the output pressure of the feedpump. As mentioned above the port 44 communicates with a drain, that is to say the pressure in the port 44 is less than the pressure in the cavities defined within the housing of the apparatus.

As a result when the groove 43 is in communication with the port 25 and whilst the inlet port 23 is in communication with an inlet passage 22, the pressure of fuel acting on the outer ends of the plungers will cause them to move inwardly, the displaced fuel flowing through the port 44 to the drain. Fuel will therefore escape from the bore 14 so that the plungers no longer engage the cam lobes. The pressure waves mentioned above will therefore not occur and no further fuel will flow from the injection nozzles. If desired and as shown in FIG. 3, the port 44 may be provided with a non-return valve 46 and this will serve to prevent fuel being drawn into the bore 14 by the centrifugal force acting on the plungers 15 in the event that the pressure acting on the outer ends of the plungers 15 should fall.

Figure 4:
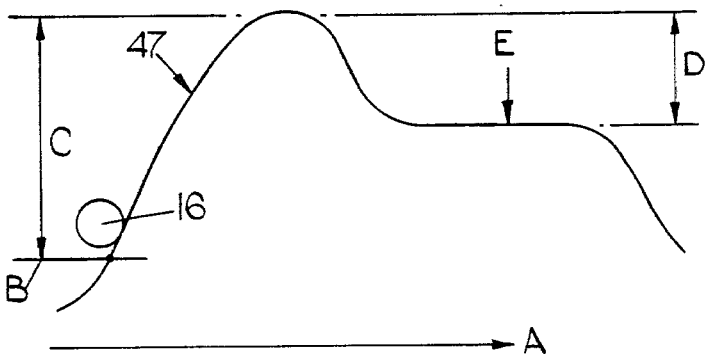
FIG. 4 is a developed view of a part of the apparatus of FIG. 1.

Referring now to FIG. 4 there is shown at 47 the profile of a cam lobe on the internal peripheral surface of the cam ring 17. There is also shown in FIG. 4 a roller 16 engaging the cam lobe and as the roller 16 moves in the direction of the arrow A, it will be moved upwardly to urge the associated plunger 15 inwardly thereby displacing fuel. Assuming that the roller 16 starts at a position shown at B, then the inward movement of the plunger will be represented by the distance C. The cam lobe is so shaped on its trailing face that an initial outward movement of the roller can occur, followed by a period during which the roller is held against outward movement. When the roller moves over the crest of the cam lobe and starts its limited outward movement, a limited quantity of fuel flows back from the pipe line since during this time, the delivery passage 19 is in communication with an outlet. The movement therefore of the roller during retraction is represented by the distance D. Whilst the roller is held against outward movement, it is arranged that the delivery passage 19 moves out of register with an outlet port 20 and that immediately an inlet passage 22 moves into register with the inlet port 23. This happens in any case with pumps for supplying fuel to six cylinder engines but does not normally occur for pumps which supply fuel to a four cylinder engine. The porting of the latter pump can however, be suitably modified. Position E represents the position at which an inlet passage is brought into register with the inlet port 23. When this occurs the pressure of fuel in the bore 14 will be dissipated by the fact that a small volume of fuel will flow from the bore 14 through the port 24 and out through the port 44. This slight flow of fuel will tend to occur each time with the result that the amount of fuel in the bore 14 will be gradually reduced. In this case the port 44 instead of being connected to the tank as shown in FIG. 2, is connected to the aforesaid pressurised cavity in the portion 9 of the housing of the apparatus and once again a non-return valve 46 is provided. The arrangement shown in FIG. 4 obviates the need for a connection between the port 44 and the external drain. It enables the fuel in the bore 14 to be displaced within the housing of the apparatus and therefore an additional drain connection is not required. It is important with this embodiment that the inlet port is opened to an inlet passage whilst the roller is held against outward movement and the cam must therefore be designed so that whatever its angular position the aforesaid condition applies.

We claim:

1. A fuel pumping apparatus for supplying fuel to an internal combustion engine and of the kind comprising a housing, a distributor member rotatable within the housing, an injection pump including a rotary part rotatable with the distributor member, a bore formed in said rotary part, a pumping plunger located in said bore, a cam ring located in the housing, said cam ring having spaced cam lobes which can impart inward movement to the plunger as the rotary part and distributor member rotate, a plurality of outlet ports formed in the housing and which in use, are connected to fuel injection nozzles respectively of an associated engine, a delivery passage in the distributor member, said delivery passage communicating with said bore and being positioned to register with the outlet ports in turn during successive periods of inward movement of the plunger, fuel supply means in the housing and distributor member through which fuel can flow to said bore at least during part of the time the delivery passage is out of register with an outlet port, said fuel supply means including a supply passage in the housing, a source of fuel under pressure for supplying fuel to said supply passage, throttle means for controlling the flow of fuel through said supply passage and means operable in association with said throttle means for allowing the bore to be vented to a low pressure when the throttle means is set to prevent fuel flow from said source to the bore.

2. An apparatus according to claim 1 in which said throttle means comprises an angularly adjustable throttle member housed in a cylinder in the housing, a first groove in the throttle member and a port in the wall of the cylinder in which the throttle member is mounted, the groove and port forming part of said supply passage, said means comprising a second groove on said throttle member and a second port in the wall of the cylinder, said second groove connecting said ports together when the throttle member is set to prevent flow of fuel through said supply passage.

3. An apparatus according to claim 2 in which said second port communicates with a drain exterior of the housing, and said plungers at their outer ends are acted upon by fuel at a pressure which is less than the pressure of fuel supplied by said source.

4. An apparatus according to claim 3 including a nonreturn valve located between said second port and said drain.

5. An apparatus according to claim 2 in which said second port communicates with the interior of the housing of the apparatus and said cam lobes each define a leading flank for effecting inward movement of the plunger and a trailing flank which defines a dwell, said delivery passage moving out of register with an outlet port whilst the plunger is held by said dwell and said first port being brought into communication with said bore whilst the plunger is held by said dwell whereby fuel under pressure in said bore will flow through said first and second ports to the interior of the housing of the apparatus.

6. An apparatus according to claim 5 including a nonreturn valve connected between said second port and the interior of the housing.

* * * * *